US008512650B2

(12) United States Patent
Jungheim et al.

(10) Patent No.: US 8,512,650 B2
(45) Date of Patent: Aug. 20, 2013

(54) DEVICE FOR MOUNTING PIPETTE TIPS, PIPETTE TIP, AND PIPETTING DEVICE

(75) Inventors: Bert Jungheim, Solingen (DE); Ulf Friederichs, Berg (CH)

(73) Assignee: Qiagen GmbH, Hilden (DE)

( * ) Notice: Subject to any disclaimer, the term of this patent is extended or adjusted under 35 U.S.C. 154(b) by 572 days.

(21) Appl. No.: 12/302,749

(22) PCT Filed: May 29, 2007

(86) PCT No.: PCT/EP2007/004746

§ 371 (c)(1),
(2), (4) Date: Mar. 25, 2010

(87) PCT Pub. No.: WO2007/137818

PCT Pub. Date: Dec. 6, 2007

(65) Prior Publication Data

US 2010/0196210 A1 Aug. 5, 2010

(30) Foreign Application Priority Data

May 29, 2006 (EP) ..... 06010976

(51) Int. Cl.
*B01L 3/02* (2006.01)

(52) U.S. Cl.
USPC ..... 422/524; 422/525; 422/511

(58) Field of Classification Search
USPC ..... 422/524–525, 501, 511, 922, 931
See application file for complete search history.

(56) References Cited

U.S. PATENT DOCUMENTS

| | | | | |
|---|---|---|---|---|
| 4,679,446 | A | 7/1987 | Sheehan et al. | |
| 4,707,337 | A * | 11/1987 | Jeffs et al. | 422/525 |
| 4,748,859 | A | 6/1988 | Magnussen, Jr. et al. | |
| 4,824,641 | A * | 4/1989 | Williams | 422/64 |
| 4,961,350 | A | 10/1990 | Tennstedt | |
| 5,496,523 | A * | 3/1996 | Gazit et al. | 422/513 |
| 5,660,797 | A * | 8/1997 | Jarvimaki | 422/525 |

(Continued)

FOREIGN PATENT DOCUMENTS

| | | |
|---|---|---|
| EP | 0351574 | 1/1990 |
| EP | 1319437 | 6/2003 |
| WO | 00/27530 | 5/2000 |

OTHER PUBLICATIONS

International Search Report based on PCT/EP2007/004746 dated Aug. 16, 2007.

*Primary Examiner* — Brian R Gordon
(74) *Attorney, Agent, or Firm* — Baker Donelson Bearman Caldwell & Berkowitz, PC

(57) ABSTRACT

The invention relates to a device for mounting pipette tips with a coupling element (4) that extends in an axial direction of the longitudinal axis (6). The coupling element (4) features a free end (8) from which a pipette tip (10) is deferrable to the coupling element (4) in an axial direction. Furthermore, the coupling element (4) features a gasket (21), at least one guiding element (25, 26), and a holding element (27). The gasket (21) consists of a flexible material which comprises an exposed sealing section (23) in an axial direction towards the free end (8) of the coupling element (4) against which a sealing section (43) of the pipette tip (10) can press axially. The guiding element (25, 26) is located on the outer side of the coupling element (4) and has the purpose of aligning the pipette tip. The holding element (27) is also located on the outer side of the coupling element (4) for interacting with holding agents (47) of the pipette tip (10).

15 Claims, 5 Drawing Sheets

(56) References Cited

U.S. PATENT DOCUMENTS

| | | | | |
|---|---|---|---|---|
| 5,770,160 | A * | 6/1998 | Smith et al. | 422/525 |
| 5,851,491 | A * | 12/1998 | Moulton | 422/535 |
| 6,117,394 | A * | 9/2000 | Smith | 422/513 |
| 6,168,761 | B1 * | 1/2001 | Kelly et al. | 422/522 |
| 6,171,553 | B1 * | 1/2001 | Petrek | 422/522 |
| 6,248,295 | B1 * | 6/2001 | Petrek | 422/525 |
| 6,596,240 | B2 * | 7/2003 | Taggart et al. | 422/525 |
| 6,967,004 | B2 * | 11/2005 | Rainin et al. | 422/522 |
| 7,033,543 | B1 * | 4/2006 | Panzer et al. | 422/525 |
| 7,335,337 | B1 * | 2/2008 | Smith | 422/513 |
| 7,785,466 | B1 * | 8/2010 | Smith | 210/321.75 |
| 8,071,050 | B2 * | 12/2011 | Smith | 422/501 |
| 8,163,256 | B2 * | 4/2012 | Cote et al. | 422/524 |
| 2002/0094302 | A1 * | 7/2002 | Taggart et al. | 422/100 |
| 2003/0000319 | A1 | 1/2003 | Rainin et al. | |
| 2003/0165408 | A1 * | 9/2003 | Takeda et al. | 422/100 |
| 2010/0316542 | A1 * | 12/2010 | Mototsu et al. | 422/525 |
| 2011/0076205 | A1 * | 3/2011 | Kelly et al. | 422/525 |
| 2011/0183433 | A1 * | 7/2011 | Motadel et al. | 436/180 |

* cited by examiner

DEVICE FOR MOUNTING PIPETTE TIPS, PIPETTE TIP, AND PIPETTING DEVICE

CROSS-REFERENCE TO RELATED APPLICATIONS

This is the U.S. National Stage entry under 35 U.S.C. §371 of International Application No. PCT/EP2007004746, filed May 29, 2007, which claims priority to European Patent Application No. 06010976.6, filed May 29, 2006.

FIELD

The invention resides in the field of metering technology and relates to a device for mounting and positioning pipette tips and to a pipette tip.

BACKGROUND

Pipette tips are elongate, typically conically tapering sleeves having a central through-opening extending along the longitudinal axis for the metering of small amounts of liquid. The pipette tips are slid at their wider end (coupling end) onto a suitable mount of a pipetting device and immersed with their pointed end, which axially opposes the wide end, into the medium to be pipetted. Typically, the pipette tips are intended for one-off use, i.e. they are discarded once they have been used.

Pipetting devices are used widely in all areas in which relatively small amounts of liquid (for example in the microliter range) have to be metered, for example in molecular biology. The pipetting device can be in the form of manual pipetting devices or pipetting machines or pipetting robots having an individual pipetting unit or a large number of individual pipetting units which are actuated at the same time or separately.

The basic mode of operation of a pipetting device is based on the fact that a defined volume of fluid is displaced, for example in a cylinder. The cylinder is in this case connected on the output side in an air-tight manner to the through-opening in the pipette tip, so that the displacement of the volume of fluid leads to a corresponding volume of the medium to be pipetted being drawn in at the pointed end of the pipette tip. In order to ensure precise metering, the pipette tip must be connected securely and tightly to the pipetting device. This is all the more necessary in the case of pipetting machines in which a secure fit and precise positioning of the individual pipette tips cannot be checked manually. In addition, it should be possible to manufacture pipetting devices in as low-maintenance and cost-effective a manner as possible.

A number of pipetting devices with holding devices for receiving pipette tips are known. Thus, for example, US 2002/094302, U.S. Pat. No. 4,679,446, DE 197 08 151 and U.S. Pat. No. 4,748,859 describe pipette tips having on the inner wall of their coupling end integrally formed peripheral sealing strips which seal the pipette tip radially against an outer circumferential surface of the mount. At the same time, lateral positional orientation of the pipette tip is intended to be attained in this way.

Complexly embodied radial seals are also described in US 2003/219359 and US 2004/011145. These seals consist of sealing lips which are formed integrally with the inner wall of the pipette tip and are intended to nestle against an outer circumferential surface of the mount. Nevertheless, the production costs for manufacturing the sealing lips are relatively high. In addition, the lateral fit of the pipette tip with sealing lips cannot be sufficiently ensured.

Axial orienting means can additionally be provided for orienting the pipette tips axially, i.e. in the z direction. These are described for example in U.S. Pat. No. 6,168,761, US 2003/082078, CA 2 122 244, U.S. Pat. No. 6,248,295, EP 148 333, U.S. Pat. Nos. 6,973,845 and 4,824,641.

All the aforementioned pipette tips are held by crimping the peripheral seal on the outer circumferential surface of the mount. U.S. Pat. No. 5,200,151, on the other hand, discloses fixing using separate locking ribs which are formed integrally with the inner wall of the through-opening in the pipette tip and engage after a locking mount encircling the outer circumferential surface of the mount.

A holding device with a rigid sealing collar is described in US 2003/0000319. This sealing collar interacts in the radial direction with a sealing surface of a pipette tip, the wall thickness of the pipette tip being sufficiently thin in the region of the sealing surfaces to ensure slight expansion during sliding onto the sealing collar.

EP 1 319 437 describes a holding device with an O-ring for radially sealing a pipette tip.

A radial seal between the pipette tip and holding device is described in EP 0 351 574 in which the holding device has a cylindrical sealing portion corresponding to a sealing portion of the pipette tip, the wall thickness in the region of the pipette tip-side sealing portion being thinner than adjacent regions, and thus flexible, in its configuration. This is achieved by a reduction in wall thickness on the inside and outside of the pipette wall. A pipette tip with a resilient cylindrical sealing portion is also described in WO 00/27530.

WO 00/62933 discloses a pipetting device having an annular crimp seal for radially sealing the pipette tip. For the purposes of sealing, a displaceable crimp sleeve is pressed onto the annular crimp seal, thus pressing said crimp seal radially outward into an annular groove formed on the inner wall of the through-opening in the pipette tip. A coupling sleeve, which has an annular stepped attachment and serves axially and radially to position the pipette tip, is arranged upstream of the crimp seal axially in the direction of the pipette tip. In the case of the pipetting device of WO 00/62933, the pipette tip is held and sealed by the crimp seal, although said crimp seal requires movable elements for actuation thereof. This leads to higher maintenance and appliance costs. Also, the crimp seal is subject to increased wear owing to the required flexing work.

SUMMARY

Against this background, the invention is therefore based on the object of providing a device for mounting pipette tips, or corresponding pipette tips which allow precise metering and preferably have improved product properties with regard to wear, maintenance, and manufacturing costs compared to the prior art. The invention therefore proposes a device for mounting pipette tips with a coupling element which has a longitudinal axis extending in the axial direction and has a free end from which a pipette tip can be slid onto the coupling element in the axial direction, wherein the coupling element has:

- a sealing element which is made of a resilient material and has an axial and radially extending sealing portion which is exposed in the axial direction toward the free end of the coupling element and against which a sealing portion of the pipette tip can be axially pressed at least in part.

According to one aspect of the invention, the coupling element can furthermore have at least one guide element arranged on the outside thereof for laterally orienting the pipette tip in relation to the longitudinal axis.

According to a further aspect of the invention, a holding element can be arranged on the outside of the coupling element for interacting with holding means of the pipette tip in order to press the sealing portion of the pipette tip against the axial sealing portion and to position the pipette tip in the axial direction.

According to the invention, the pipette tip is sealed by an axially acting seal on the coupling element. For this purpose, the coupling element has a resilient sealing element against which a sealing portion of the pipette tip can be axially pressed. The advantage of an axial seal is that it is subject to much less wear than a radial seal. A radial seal has to be slid with friction over an outer circumferential surface of the mount until it has been sufficiently crimped and thus produces an adequate seal, or is subjected, as in the case of the above-described crimp seal of WO 00/62933, to considerable flexing work. In the case of an axial seal, on the other hand, the corresponding sealing portion need merely be pressed against the seal. The mount according to the invention thus has a much longer service life and is subject to much less wear. The sealing element consists in this case of a material which is more resilient or displays better elastic deformability than the material of the coupling element. The sealing element has an axial sealing portion, i.e. a portion which can be accessed from the axial direction, for example an end surface, against which the sealing portion of the pipette tip can be axially pressed.

Furthermore, the seal and mount or fastening are advantageously separated from each other both spatially and functionally, i.e. the sealing element and holding element are embodied as separate elements. The sealing element seals the pipette tip on the coupling element. In addition, it serves, owing to the axial sealing effect, also as an axial positioning means. Nevertheless, the pipette tip is not held or fastened by the seal. This function is performed by the holding element which interacts with an associated holding means on the pipette tip and secures said pipette tip against axial displacement. In this case, the sealing portion of the pipette tip is at the same time pressed against the axial sealing portion of the sealing element and, on the one hand, the desired sealing effect is achieved and, on the other hand, the axial position of the pipette tip is defined by the holding element and sealing element. The holding element allows a detachable connection between the coupling element and pipette tip.

Finally, in an advantageous manner, the lateral or radial orientation of the pipette tip on the coupling element is ensured by interaction of the mount-side guide element with corresponding guide elements, typically cylinder surfaces on the inner wall of the pipette tip.

The separation of the sealing and mounting function and also lateral guidance is advantageous in particular in the case of pipetting machines, as it allows the axial orientation (z position) to be precisely defined by the interaction of the axial seal and holding element. A radial crimp seal could on the other hand prevent defined axial positioning. Furthermore, the mounting device according to the invention has a low-wear seal and permits precise positioning of the pipette tip and also secure mounting thereof.

The invention further relates to a pipette tip for placing on a mount, wherein the pipette tip has:

a lateral surface extending about a longitudinal axis; and a coupling portion which is in proximity to a first axial end of the pipette tip and arranged in the sliding-on direction, the coupling portion having at least one portion having an inner wall which tapers conically, at least in certain portions, counter to the sliding-on direction and into which a guide surface, which is cylindrical in relation to the longitudinal axis, is integrated.

The integrated cylindrical guide surface should preferably extend in the longitudinal direction parallel to the longitudinal axis. This allows the pipette tip to assume, during interaction of its guide surface with a guide element of the mount, a defined radial position irrespective of its axial position. The pipette tip can therefore be slid onto the mount without the guide surface impeding an axial movement of the pipette tip and mount relative to each other. The guide surface therefore leads merely to a radial orientation of the pipette tip without influencing the axial position thereof, i.e. the axial and radial orientations are separate.

The inner wall has, in the longitudinal axial direction in relation to the longitudinal axis, typically an angle of greater than or equal to 0.2°, preferably between 0.5° and 3°, in particular between 0.5° and 1°. The angle can also lie between approximately 0.2° and 1° and be for example approximately 0.3°. As a result of the relatively small angle, the inner wall is shaped as a mold release bevel for easier removal of the manufactured pipette tip from an injection mold in the case of comparatively low tapering of the hollow cross section.

The coupling portion can furthermore have a first portion and a second portion arranged axially offset from the first portion in the pushing-on direction, the first portion having a smaller radial extension than the second portion. In addition, the coupling portion can have a sealing portion between the first and second portion having a sealing surface pointing axially in the pushing-on direction for interacting with a sealing element of the mount. Furthermore, the coupling portion can have a holding means arranged on the inner wall of the second portion for interacting with a holding element of the mount. The cylindrical guide surface can be arranged in the first portion, in the second portion or in both portions.

The holding means can be an undercut formed on the inner wall of the second portion. Typically, the pipette tip is an injection-molded part, the inner walls of the first and second portion extending parallel to the longitudinal axis, i.e. having no mold release bevels. Furthermore, the coupling portion, and in particular the second portion of the pipette tip, can comprise a region which is embodied so as to be more flexible in relation to the remaining regions of the coupling portion or the second portion and is arranged toward the first axial end. The flexible region facilitates the placing of the pipette tip on and stripping thereof from the mount. In order to improve and purposefully to adjust the flexibility, it is possible to provide incisions extending in the coupling portion or in the second portion of the coupling portion and to fill said incisions with a second material which is more resilient than the material of which the remaining regions of the coupling portion or the second portion consist. The coupling portion therefore consists of different materials.

The sealing portion can be formed by a shoulder or heel between the first and second portion.

According to a further aspect, also proposed is a device for mounting pipette tips with a coupling element which has a longitudinal axis extending in the axial direction and has a free end from which a pipette tip can be slid onto the coupling element in the axial direction, wherein the coupling element has on its outside:

two guide elements set axially apart from each other, and a holding element which is separate in relation to the guide elements for interacting with holding means of the pipette tip in order to position the pipette tip in the axial direction.

The holding element can be a flexible element which is suitably mounted on the outside of the coupling element, or a rigid or resilient element formed integrally with the outside or fastened separately to the outside, for example one or more radial elevations distributed partially or annularly on the circumferential side.

A further aspect proposes a pipetting device with a coupling element and a pipette tip which can be detachably fastened to the coupling element and has a sealing portion, the coupling element having a longitudinal axis extending in the axial direction and having a free end from which the pipette tip can be slid onto the coupling element in the axial direction. The coupling element also has a sealing element which is made of a resilient material and has an axial and radially extending sealing portion which is exposed in the axial direction toward the free end of the coupling portion. The sealing portion of the pipette tip is on the other hand configured, in relation to the longitudinal axis of the coupling element, preferably as an axial surface pointing in the direction of the coupling element and can for example be formed by a shoulder. In the coupled state, at least a part of the sealing portion of the coupling element should be axially pressed against at least a part of the sealing portion of the pipette tip. The coupling element of the pipetting device can additionally have, individually or in combination, the properties of the separate coupling element described hereinbefore, for example with regard to the properties and the material of the sealing element, the number, configuration and arrangement of guide elements or the number, configuration and arrangement of holding elements.

A further aspect proposes a pipetting device with a coupling element and a pipette tip which can be detachably fastened to the coupling element, wherein the coupling element has at least one guide element arranged on the outside thereof for laterally orienting the pipette tip, and preferably comprises as many guide elements as the pipette tip has guide surfaces. The guide element or elements can in this case be embodied independently of one another, preferably in one piece or in a plurality of parts. The pipette tip has a longitudinal axis and a coupling portion extending in the longitudinal axis for sliding onto the mount. The coupling portion has furthermore at least one portion having an inner wall which tapers conically, at least in certain portions, counter to the sliding-on direction and into which a guide surface, which is cylindrical in relation to the longitudinal axis, is integrated for interacting with the at least one coupling-side guide element. The guide element or elements on the coupling part is (are) configured in such a way that each guide element has at least partial surfaces of a cylindrical lateral surface which corresponds in each case to a cylindrical guide surface, interacting with the partial surface, at the pipette tip. The pipette tip can in addition have, individually or in combination, the properties of the above-described separate pipette tip, for example with regard to the properties, the material, the configuration and arrangement of the inner wall, of specific portions or of holding elements. In addition, the coupling element of the pipetting device can in this case also have, individually or in combination, the properties of the above-described separate coupling element, for example with regard to the number, configuration and arrangement of guide elements. In addition, the coupling element can comprise a sealing element having above-described properties, configurations and also suitable materials and one or more holding elements described hereinbefore in relation to number, configuration and arrangement.

The coupling element can furthermore have at least one holding element arranged on its outside for interacting with at least one holding means of the pipette tip. In this case, the at least one holding element can be embodied rigidly relative to the at least one holding means. Alternatively, the at least one holding element can also be embodied flexibly relative to the at least one holding means.

BRIEF DESCRIPTION OF THE FIGURES

The invention will be described hereinafter based on exemplary embodiments which are illustrated in the figures and reveal further advantages and modifications. In the drawings.

DETAILED DESCRIPTION

Figure 1:
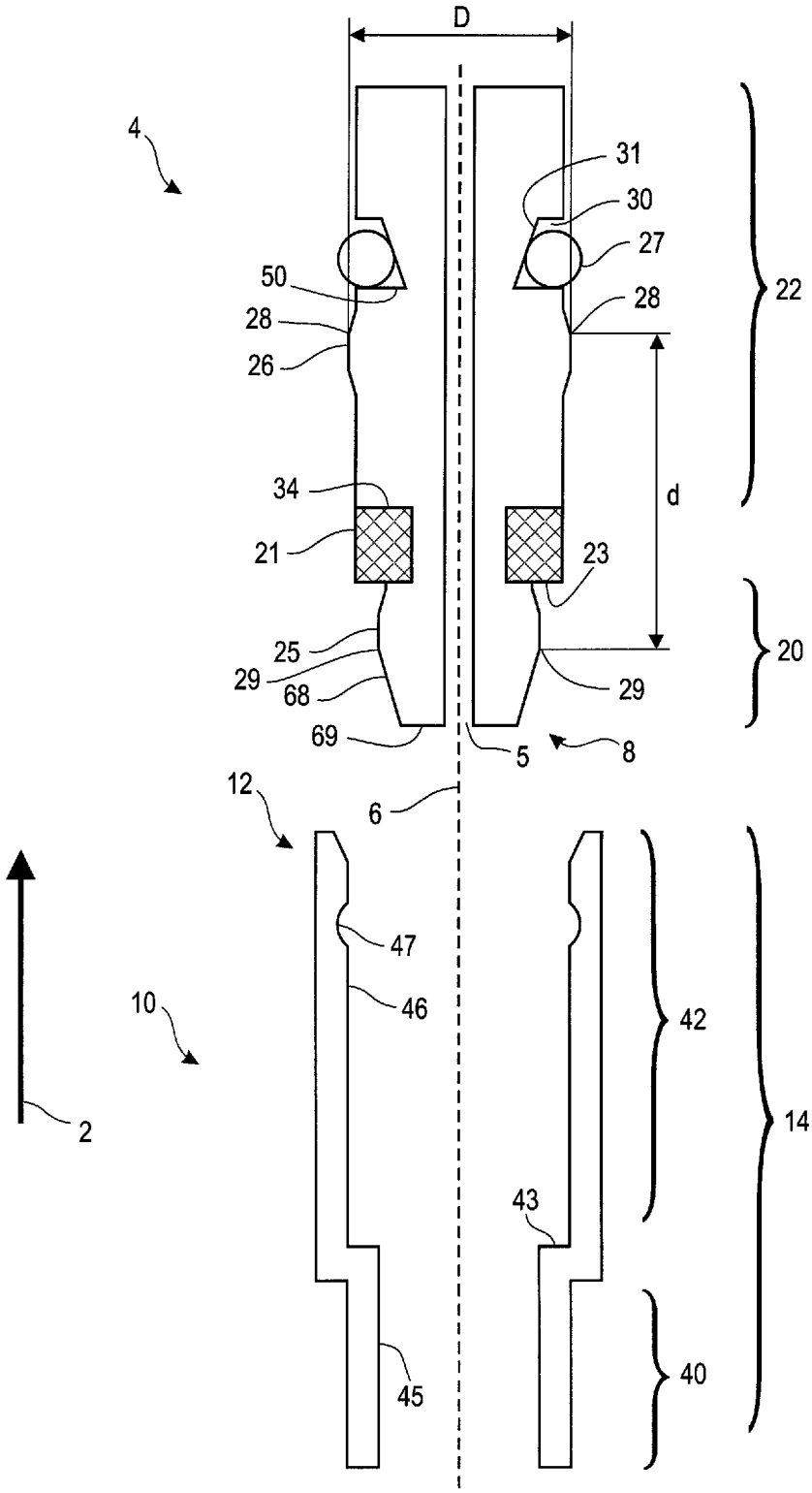
FIG. 1 is a sectional view of a mount with a coupling element and pipette tip according to a first embodiment.

Specific mounts are used for secure fastening and holding of pipette tips on pipetting devices or pipetting machines. The mount according to the invention has for this purpose a coupling element which has an in particular cylindrical basic element and comprises a resilient sealing element having a sealing portion which is exposed axially in the direction of the free end of the mount and extends radially at least in part. A corresponding sealing portion of a pipette tip can be slid axially against this sealing portion. The sealing effect is in this case achieved by axial pressing against the sealing element. Typically, the sealing element consists of a fluoroelastomer and can for example be embodied as an O-ring or else as an X-ring, wherein O and X relate to the cross section of the ring material. Other cross sections, for example hollow or V-shaped cross sections, are also possible. The selection of the respective cross section is intended to provide material resilience in cross section, i.e. the cross section of the sealing element is elastically deformable, in particular in the longitudinal direction of the coupling element, and therefore allows a very good axial sealing effect.

The coupling element has furthermore at least one guide element for laterally positioning and orienting the pipette tip—in relation to the longitudinal axis of the mount. In particular, the guide element can be embodied so as to encircle the coupling element radially, preferably with a constant radial extension, wherein it can consist of partial elements. In this case, the guide element can protrude radially beyond adjacent portions of the outside of the coupling element. The guide element thus has a greater radial extension than adjacent portions of the coupling element. This ensures that radial contact between the coupling element and pipette tip is established substantially only via the guide element, so that the guide element determines the lateral or radial position of the pipette tip. Typically, the guide element rests against the inner wall of the pipette tip which can in turn have corresponding guide elements or guide surfaces. The guide element can be annular. The mount-side guide element is in particular in the form of guide surfaces or partial surfaces which are cylindrical in relation to the longitudinal axis of the coupling element. As a result, the lateral guidance and orientation of the pipette tip is, in contrast to conical surfaces, independent of axial positioning means.

In one embodiment of the mount according to the invention, the coupling element can have two guide elements set axially apart from each other on the outside thereof. This further improves the lateral or radial orientation or positioning of the pipette tip. Improved coaxial orientation of the coupling element and pipette tip is also achieved, i.e. tilting or oblique holding of the pipette tip on the mount is prevented. This is advantageous in particular in the case of pipetting machines with a large number of pipette tips which are actuated at the same time and arranged for example in a matrix-type manner.

It is beneficial if both guide elements have an axial spacing which is at least as large as the largest radial extension thereof. The term "axial spacing of the guide elements" refers in this case to the distance between the contact regions or contact edges lying furthest apart from one another. For example, the guide elements can define guide rings extending radially around the coupling element and having a differing radial extension or differing external diameter. In this case, the axial spacing is defined by the respective outer edge or outline of the guide surface, i.e. the outer edges which are axially furthest apart from one another. The guide rings can in this case optionally be embodied as continuously encircling rings or else as interrupted rings. It is also possible to embody one guide ring as a continuously encircling ring and the other guide ring as an interrupted ring.

The guide element or the guide ring or rings can have a certain axial extension, thus defining guide surfaces, the axial width of which corresponds substantially to that of the axial extension of the guide rings or the guide element. It is likewise possible to reduce the axial extension of the guide element or the guide ring or rings until one or more substantially linear contacts remain between the guide element and pipette tip. If, for example, a plurality of annularly arranged guide elements are used, one or more point-by-point contacts with the pipette tip can in each case also be established in the case of a corresponding configuration.

Typically, the coupling element has two guide elements with a differing radial extension or external diameter, the axial spacing of the two guide elements from each other being at least as large as the larger of the two external diameters.

In a further embodiment of the invention, the coupling element has a first portion which is arranged close to the free end or at the free end of the coupling element and a second portion which is arranged axially offset in the pushing-on direction in relation to the first portion. Typically, the portions are substantially cylindrical. Each portion can have a guide element, wherein in particular the first portion facing the free end has preferably at each point a smaller radial extension than the second portion. This defines between the two portions a step on which the sealing element can be arranged. The sealing element accordingly lies preferably between the first and second portion and protrudes in the radial direction typically beyond the first portion and the guide element located there, so that a part of the sealing element is freely accessible axially from the free end of the coupling element.

An inner stepped heel of the pipette tip, which is formed by a radially peripheral sealing surface pointing in the axial direction, can for example be pressed against the sealing element.

The coupling element has furthermore at least one holding element which is arranged on the outside of the coupling element, interacts with corresponding holding means of the pipette tip and detachably fixes the pipette tip. The holding element causes in this case in particular axial fixing, so that the sealing portion of the pipette tip is as a result at the same time pressed axially against the axial sealing portion of the coupling element. In addition, the interaction of the sealing element with the sealing means, on the one hand, and the holding element and holding means, on the other hand, provides secure and precisely defined axial positioning of the pipette tip. The holding element can be embodied flexibly or rigidly.

The holding element can be a flexible tensioning element, for example a peripheral spring element, arranged in a peripheral depression located on the outside of the coupling element. Flexible holding elements allow the pipette tip to be slid on or stripped with the application of little force. In addition, flexible holding elements are relatively low-wear and comparatively fault-tolerant, as their flexibility allows them partly to compensate for production tolerances, for example of the pipette tip.

Alternatively, the holding element can also be embodied rigidly and have for example individual radial elevations, for example rigid cams or knobs, which are distributed preferably annularly around the coupling element. A non-annular distribution or a continuous ring are also suitable as rigid holding elements. Rigid holding elements have the advantage over flexible holding elements of allowing more precise centering of the pipette tip.

Irrespective of the particular specific configuration of the holding element, said holding element can engage with a radially peripheral undercut at the pipette tip, which is typically arranged on the inner wall of the through-opening in the pipette tip.

In a further embodiment of the invention, the holding element is arranged, viewed in the sliding-on direction, after the guide element or elements. This ensures that the sealing element is located before the holding element in the direction toward the free end of the coupling element and as a result protects the holding element from accidental contamination with the medium to be pipetted.

A first embodiment will now be described with reference to FIG. 1. The holding device comprises an axially symmetrical, typically substantially cylindrical coupling element 4 having a longitudinal axis 6 and an axially arranged through-opening 5. The coupling element has a leading free end 8. From the free end 8, a pipette tip 10 can be slid onto the coupling element 4. Typically, the pipette tip 10 is shaped axially symmetrically and has close to its trailing end (coupling end or first axial end) 12 a coupling portion 14 which is slid onto the coupling element 4. The pipette tip tapers conically from its coupling portion 14 to its leading pointed end (not shown here) and has at this end an intake opening for drawing in the medium to be pipetted.

The pipette tip is typically intended for one-off use and embodied as an injection-molded part. A suitable material, which is easy to process, for pipette tips is polypropylene which can be injected into a suitable injection mold in liquid form and optionally mixed with additives (for example dye) and/or fillers. Once the polypropylene has solidified, the finished pipette tip is expelled from the injection mold and, if necessary, the gate is removed.

The coupling element 4 is typically formed in one piece from metal and has at its free end 8 a first portion 20. A second portion 22 of the coupling element 4 is arranged offset axially in the sliding-on direction 2 in relation to the first portion 20. The first portion 20 has preferably at each point a smaller radial extension than the second portion 22, so that the second portion 22, the rear portion in the sliding-on direction 2, protrudes radially beyond the first portion 20. A respective guide element 25, 26, in the form of a peripheral cylindrical guide surface, is arranged on the outside of each portion. The guide elements 25, 26, which extend in the longitudinal direction parallel to the longitudinal axis 6, have a greater radial extension than adjacent regions of the respective portions 20, 22 over which they extend radially. This is intended to ensure that the pipette tip 10 enters radially into contact merely with the guide surfaces and, as a result of the interaction of the guide surfaces with the inner wall of the coupling portion 14, the radial orientation or positioning of the pipette tip 10 in relation to the coupling element 4 is defined. At the same time, the two guide elements 25 and 26, which are arranged axially offset relative to each other, also prevent oblique placement of the pipette tip 10 or tilting thereof onto the coupling element 4. Preferably, the two guide elements 25, 26 have an axial spacing d which is at least as large as the diameter D (radial extension) of the larger of the two guide elements, i.e. in this case the second guide element 26. This further improves the coaxial orientation of the pipette tip 10 on the coupling element 4. The spacing d is in this case defined by the spacing of the respective outer edges 28, 29 of the guide elements 25, 26. These outer edges form the axial end regions of the contact between the guide elements 25, 26 and the pipette tip.

Figure 3:
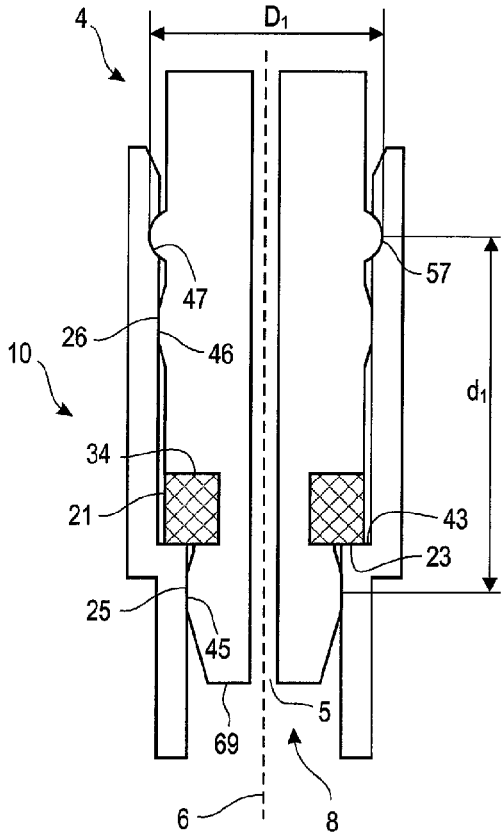
FIG. 3 is a sectional view of a mount with a coupling element and slid-on pipette tip according to a second embodiment.

Insofar as the coupling element has merely the first guide element 25 (see FIG. 10), the holding element 27 has, in interplay with the first guide element 25, the function of laterally orienting the pipette tip. In this case, the distance $d_1$ between the holding element 27 and guide element 25 is, as shown in FIG. 3, likewise greater than the diameter $D_1$ of the holding element 27 (see also FIG. 11).

Like the first and second portion 20, 22 of the coupling element, the coupling portion 14 of the pipette tip 10 also has a first portion 40 and a second portion 42, the first portion 40 having a smaller radial extension (diameter) than the second portion 42. This forms between the first and second portion 40, 42 a step or shoulder 43 which serves as a sealing surface 43.

In the exemplary embodiment shown, the first and second guide elements 25 and 26 are shaped in substantially the same way. Nevertheless, it is also possible to give a different shape to each of the guide elements. In the present exemplary embodiment, the guide elements 25, 26 are embodied at the periphery and rise above the outer contour surrounding them of the respective coupling element-side portions 20, 22 in the form of an integrally formed ring which has a peripheral guide surface and the cross section of which is trapezoidal.

Figure 4:
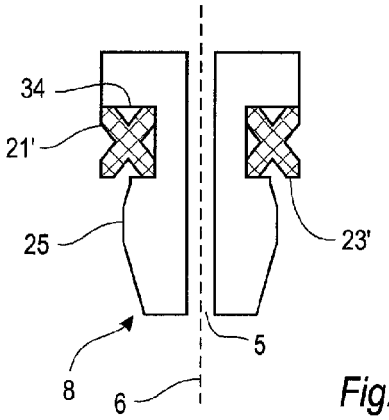
FIG. 4 shows a detail of a coupling element with an X-shaped sealing element.

Between the first and second portion 20, 22 extends a depression or undercut 34 which encircles radially on the outside of the coupling element 4 and in which a likewise radially encircling sealing element 21 rests. The sealing element is beneficially a ring seal made of a resilient material. Fluoroelastomers have in particular proven to be suitable materials, as they have high resilience, a long service life, high chemical resistance and low wear. In the present exemplary embodiment, the sealing element is embodied as a solid ring which is rectangular in cross section. Nevertheless, it is also possible to use ring seals having a circular (O-rings) or X-shaped cross section. For example, ring seals having an X-shaped cross section are, owing to the individual sealing lips, more resilient than O-seals and therefore lead to even better sealing of the pipette tip on the coupling element. A sealing element 21' having an X-shaped cross section is illustrated by way of example in FIG. 4. The sealing element 21' has four sealing lips, the sealing lip 23', which points radially outward toward the free end 12, being the axial sealing portion 23 against which the corresponding sealing portion of the pipette tip is pressed.

Figure 2:
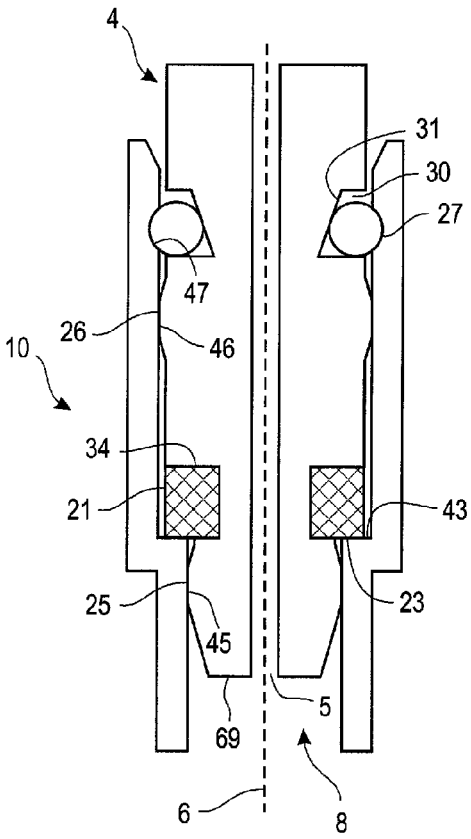
FIG. 2 is a sectional view of a mount with a coupling element and slid-on pipette tip according to the first embodiment.

The sealing element 21 shown in FIG. 1 has substantially the same radial extension as the second portion 22 and as a result protrudes beyond the first portion 20 in the radial direction. Therefore, a sealing portion 23 is substantially axially exposed in the direction of the open end 8 of the coupling element 4. The sealing portion 23 serves as an axial sealing surface and is pressed axially against the peripherally embodied internal shoulder 43 of the pipette tip 10. As may be seen in relation to FIG. 2, which shows a pipette tip 10 placed fully onto the coupling element 4, merely the axial sealing portion 23 of the sealing element 21 is in direct contact with the inner wall of the pipette tip and in particular with the shoulder 43. As a result, axial sealing and at the same time z orientation are attained. The z orientation is furthermore defined by a holding element, as will be described hereinafter.

The sealing element 21 has an external diameter somewhat smaller than the internal diameter of the second portion 42 of the pipette tip. This ensures that the inner wall of the pipette tip is not guided with friction via the sealing element 21 during sliding-on, as a result of which it is subjected to far fewer loads than radial seals which have to be slid with friction via conventionally conically tapering surfaces to achieve an adequate sealing effect. Therefore, the maintenance costs of the axial sealing element 21 according to the invention are also considerably lower.

A radial contact between the coupling element 4 and pipette tip 10 is established via the coupling element-side guide elements 25 and 26 and via first and second guide surfaces 45 and 46 of the coupling portion 14 of the pipette tip 10. In the simplest case, the pipette tip-side guide surfaces 45, 46 can be formed by the inner walls of the respective portions 40, 42 of the pipette tip 10. Nevertheless, it is also possible to form raised guide surfaces integrally with the inner wall of the pipette tip. Each portion of the pipette tip-side coupling portion 14 has a guide surface 45, 46 which encircles continuously or consists of partial segments which are distributed over the circumference side, the diameter of said guide surface corresponding to the external diameter of the respectively associated first and second guide element 25, 26, so that a form-fitting orientation of the pipette tip 10 is attained.

In order to allow orientation with as precise a fit as possible, the corresponding guide surfaces 45, 46 do not have any mold release bevels. Mold release bevels are conventionally provided on injection-molded parts in order to be able to release said parts more easily from the injection mold. Because mold release bevels are dispensed with, the pipette tip-side guide surfaces extend in the axial direction parallel to the axis 6. As a result, the radial or lateral orientation of the pipette tip does not depend on how far the pipette tip is slid onto the coupling element. In the case of conically tapering guide surfaces, said guide surfaces would, during the sliding of the pipette tip onto the coupling element, increasingly be braced on the coupling element and as a result resist the axial movement. Thus, conical guide surfaces influence the axial orientation and increase the required pushing-on force. An annular groove 30 for receiving an annular spring 27 is formed after the second guide element 26 in the sliding-on direction. The annular spring 27 serves as a holding element and engages with an undercut 47 on the inside of the second portion 42 of the pipette tip. During placement of the pipette tip, said pipette tip is slid, with its trailing end 12 in front, over the second guide element 26 and the annular spring 27 until the annular spring 27 snaps into the undercut 47. As a result, the pipette tip is positioned axially and fixed to the coupling element. The annular spring 27 and undercut 47 establish a detachable connection which is at the same time sufficiently stable to press the shoulder 43 axially against the axial sealing portion 23 and thus to seal the pipette tip on the coupling element. The annular spring can have a slight screw thread.

In accordance with the geometric configuration of the coupling element, the guide surfaces 45 and 46 of the pipette tip, which, when placed on, interact with the coupling element-side guide elements, are typically at a distance from each other that is greater than the internal diameter of the second guide surface 46. Likewise, should no second guide element 26 be arranged on the coupling element, the distance between the first guide surface 45 and undercut (holding means) 47 is greater than the internal diameter of the depression in the undercut 47. As the holding element 27 is typically arranged after the second guide element 26 in the sliding-on direction 2, this relationship applies also if two guide elements 25, 26 or guide surfaces 45, 46 are used. The first guide element 25 can be arranged close to the sealing portion 23. Accordingly, the guide surface 45 can be embodied close to the shoulder 43. In this case, the distance of the shoulder 43 from the undercut 47, in particular from the center of the undercut 47, is typically also greater than the internal diameter of the undercut 47.

Figure 11:
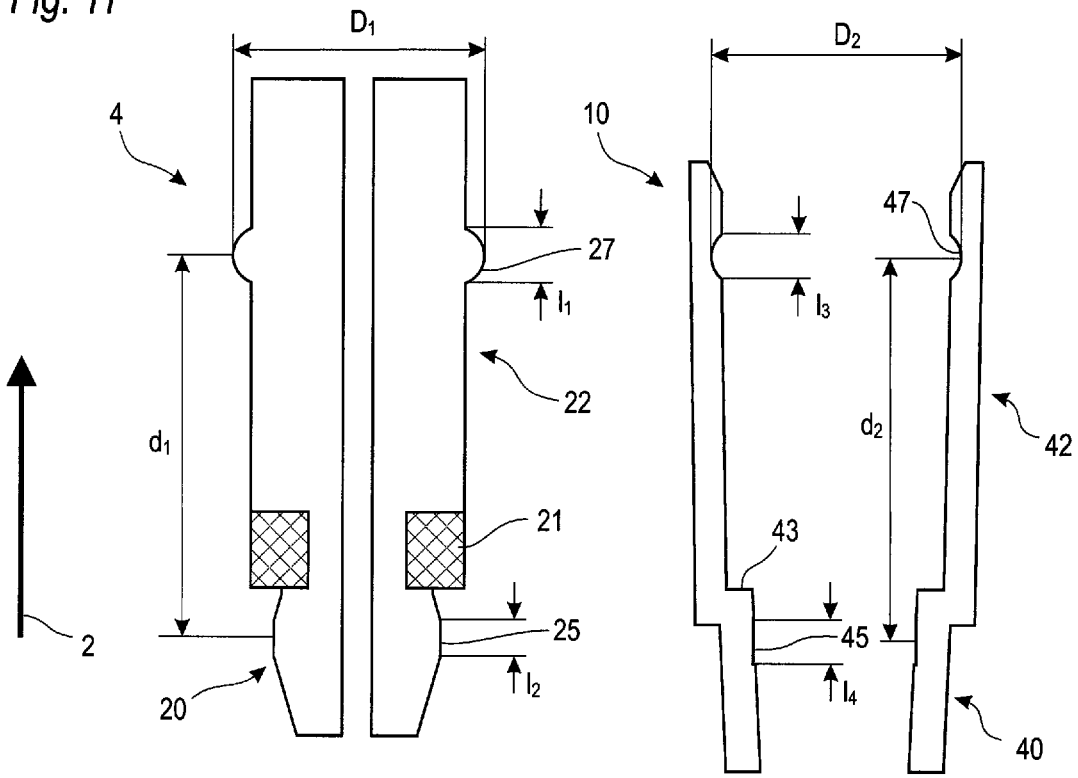
FIG. 11 shows geometric ratios between the guide width $d_i$, external diameter $D_i$ and width $l_i$ of the individual guide elements or guide surfaces of a coupling element or a pipette tip.

This situation is indicated in FIG. 11 which shows a coupling element 4 and a pipette tip 10 according to one exemplary embodiment. In this exemplary embodiment, the coupling element 4 has a first guide element 25 in the form of a surface which is arranged before the sealing element 21 in the sliding-on direction 2, i.e. in the first portion 20 of the coupling element 4. A holding element 27 in the second portion 22 of the coupling element 4 is arranged after the sealing element 21 in the sliding-on direction 2. A second guide element is not provided here. The pipette tip 10 has a guide surface 45 which corresponds to the guide element 25 of the coupling element 4 and rests before a sealing portion or shoulder 43 in the sliding-on direction 2, i.e. is arranged in the first portion 40 of the pipette tip 10. The inner surface of the pipette tip 10 is shown here extending slightly conically, the guide surface 45 being embodied as a cylindrical surface integrated into the wall of the pipette tip 10. This will be described hereinafter in greater detail in relation to FIG. 8. A holding means 47, in the form of an undercut, is arranged in the second portion 42 of the pipette tip 10 set apart from the sealing portion 43.

On the coupling element 4, the holding means 27 and holding element 25 are at a distance $d_1$ from each other which is also referred to as the guide width. The guide width $d_1$ is determined from the center of the respective elements. The axial extension (width of the individual guide surface) of the holding means 27 and holding element 25 is denoted by $l_1$ and $l_2$ respectively. The external diameter of the holding means 27 is in this case specified by $D_1$. In order to allow secure mounting and orientation, the relationship $d_1 \geqq D_1$ should be fulfilled. In accordance therewith, the undercut 47 of the pipette tip 10 has a maximum diameter $D_2$. The guide surface 45 is at a distance (guide width) $d_2$ from the undercut 47 (based in each case on the center of said guide surface). The axial extension of the undercut 47 and guide surface 45 is specified by $l_3$ and $l_4$ respectively, wherein $l_4$ is typically greater than $l_2$, so that the heel between the cylindrical guide surface 45 and the conical inner wall (see heel 74 in FIG. 8) does not enter into contact with the holding element 25 of the coupling element 4 and impede sliding of the pipette tip 10 onto the coupling element 4. Typically, the following applies: $D_1 = D_2$ and $d_1 = d_2$, so that the relationship $d_2 \geqq D_2$ is likewise fulfilled. The guide widths $d_1$ and $d_2$, the axial extensions $l_1$, $l_2$, $l_3$ and $l_4$ and also the diameters $D_1$ and $D_2$ are adapted to one another accordingly, thus allowing the respective elements to fulfill their purpose (the guide surface 45 and guide element 25 for lateral orientation; the holding element 27 and undercut 47 in the present exemplary embodiment for lateral orientation and fixing), wherein the fixing can also be combined with slight clamping.

The geometric relations described hereinbefore ensure, regardless of whether the first and second guide element 25, 26 interact with the pipette tip-side guide surfaces 45, 46, or whether the first guide element 25 and the holding element 27 interact together with the pipette tip-side first guide surface 45 and the undercut 47 (without an additional second guide element 26), that tilting of the pipette tip on the coupling element is sufficiently reliably avoided.

In order to achieve an adequate sealing effect, the distance between the undercut 47 and the shoulder 43 should be adhered to as precisely as possible, wherein the distance is embodied in such a way that the shoulder 43 can be pressed against the sealing portion 23 to achieve an adequate sealing effect. Nevertheless, the resilience of the sealing element 21 permits a certain tolerance, wherein an X-shaped sealing element allows for the same material a somewhat higher tolerance than for example an O-ring. The distance between the shoulder 43 and undercut can for example be 8 to 9 mm. The internal diameter of the pipette tip-side second portion 42 can lie approximately between 6 and 7.5 mm, that of the pipette tip-side portion 40 approximately between 5 and 6 mm.

During sliding-on of the pipette tip, reversible slight deformation of the trailing end 12 of the pipette tip can occur, as the trailing end is stretched slightly as it passes the annular ring 27. The pipette tip should therefore be embodied to be resilient up to a certain degree at its trailing end. The resilience can be adjusted by suitable selection of the material thickness. It is nevertheless also possible to embody the annular spring 27 to be sufficiently flexible to yield during placement of the pipette tip and to penetrate the undercut 47 as it passes it.

The annular groove 30 is embodied in the present exemplary embodiment with an inclined inner wall 31 tapering conically toward the leading end 8 of the coupling element. As a result, the annular ring 27 is precisely positioned axially in the direction toward the free end 8, as it is slightly radially compressed by the pipette tip, yields owing to the conical inner wall 31 in the direction of the stop surface 50, against which it is pressed and positioned. This produces a force fit starting from the sealing element 21, via the pipette-side sealing portion 43, to the undercut 47 which guides the flow of power to the stop surface 50 via the annular spring 27. As a result, the pipette tip is securely fastened to the coupling element and oriented.

FIG. 3 shows a further embodiment. In this embodiment, the holding element used is not an annular spring arranged in an annular groove but rather rigid cams 57 which are distributed uniformly over the circumference of the second portion. At least three cams are beneficial. As may be seen from FIG. 3, the cams 57 are shaped integrally as a peripheral raised ring which is interrupted by incisions. With regard to the material stressing of the coupling portion of the pipette tip, a plurality of separate rigid cams are more beneficial than a continuous ring, as a continuous ring would force marked widening of the trailing end 12 of the coupling portion 14 during sliding-on of the pipette tip. Separate rigid cams, on the other hand, require merely slight deformation of the trailing end 12, wherein in the case of three cams the cross section of the second portion 42 assumes, until the cams engage with the pipette tip-side undercut 47, a slight triangular shape without significant material stretching. The cross-sectional deformation which is facilitated without material stretching allows a considerable reduction in the application of force required to slide on the pipette tip. Alternatively, the holding means used can also be integrally shaped conical surfaces or placed knobs or one or more placed rings.

As in the first exemplary embodiment, the cams 57 engage with an undercut 47 at the pipette tip.

Figure 5:
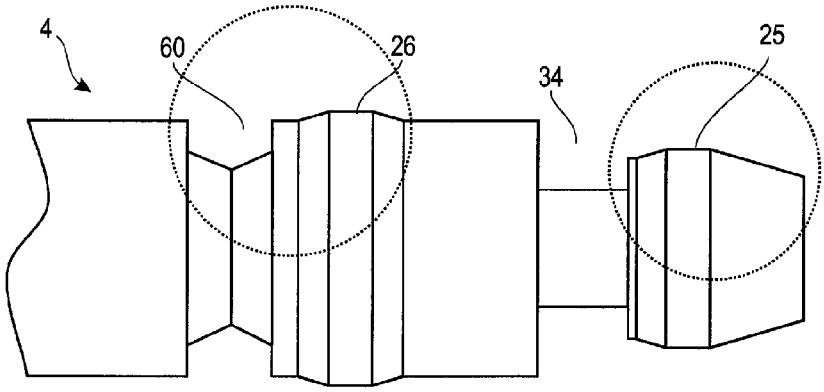
FIG. 5 is a sectional view of a mount with a coupling element according to a third embodiment.
Figure 6:
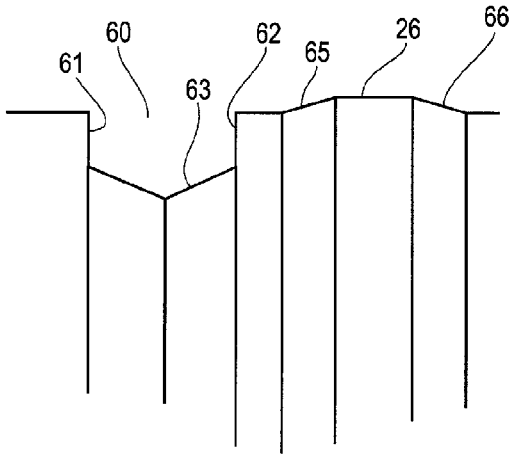
FIG. 6 shows a first detail of the coupling element according to the third exemplary embodiment.
Figure 7:
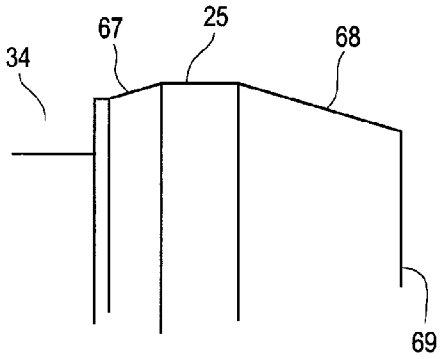
FIG. 7 shows a second detail of the coupling element according to the third exemplary embodiment.

FIGS. 5 to 7 show a further exemplary embodiment in which, again, the holding element used is an annular spring (not shown) arranged in an annular groove 60 having parallel side walls 61, 62 and a V-shaped inner wall 63. The annular groove 60 has the advantage that the annular spring is, on the one hand, mounted in a defined manner in the axial direction and, on the other hand, elastically deformable in the radial direction. This facilitates the placement of the pipette tip and leads to a long service life of the annular spring.

FIGS. 6 and 7 show details of the annular groove 60 and of the first and second portion 25, 26 of the coupling element. These figures also show the respective guide elements such as can also be used in the other embodiments.

The V-shaped inner wall 63 (FIG. 6) comprises two partial surfaces which are at an obtuse angle to each other, said partial surfaces being arranged symmetrically with respect to the axis 6. The second guide element 26 protrudes beyond surrounding regions of the coupling element-side second portion 22. As may be seen, symmetrically embodied run-on flanks 65, 66 are integrally formed laterally to the second guide element 26.

In the first portion 20 (FIG. 7), a rear run-on flank 67 and a front conical insertion bevel 68 for precentering the pipette tip are also embodied axially to the first guide element 25. The insertion bevel 68 extending to the free end 8 ends at an end surface 69 at which the through-opening 5 also ends.

Figure 10:
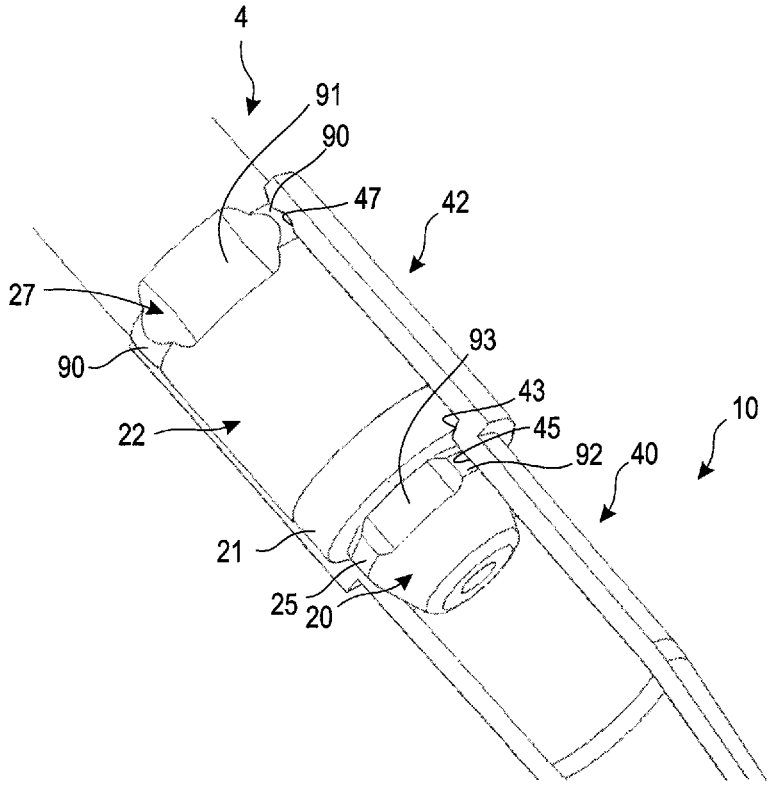
FIG. 10 is a three-dimensional view of a further coupling element with a slid-on pipette tip.

A further exemplary embodiment of a coupling element 4 is illustrated in FIG. 10. In the case of this exemplary embodiment, the holding element 27 is formed by separate cams 90 which are arranged peripherally and are for example part of a ring. The cams 90 can easily be produced from a for example integrally formed ring in which axially extending incisions 91 are formed. This produces separate and in this case rigid cams 90 which, as in the exemplary embodiments shown hereinbefore, can engage with an undercut 47 in the pipette tip 10, which undercut is provided in the second portion 42 of the pipette tip 14. By way of the interaction between the cams 90 and undercut 47, the sealing portion 43 of the pipette tip 10 is axially pressed against the sealing element 21. The ring, or the cams 90, can have in the axial direction a round contour corresponding substantially to the contour of the undercut 47 in order to allow a good form fit.

In contrast to the exemplary embodiments disclosed hereinbefore, the coupling element 4 shown in FIG. 10 does not have a separate second guide element in the region of the second portion 22 of the coupling element 4. The cams 90 perform this function in interaction with the pipette tip-side undercut 47. The second guide surface 46 in the second pipette-side portion 42 can then likewise be dispensed with. The pipette tip 10 can then have, viewed in the pushing-on direction, a first guide surface 45 in the region of the first portion 40, a shoulder 43 at the transition to the second portion 42 and a holding means 47 (in the present example an undercut) set apart from the shoulder 43.

In the region of the first portion 20 of the coupling element 4, the first guide element 25 is formed by a peripheral ring having axial incisions 93, the ring having a cylindrical outer contour. The incisions 93 lead to spatially separated ring segments 92 or cams. As a result of the cylindrical outer contour of the ring, each cam 92 has a part of the cylindrical outer contour, so that the holding element-side cams 92 jointly form a peripheral guide element in the form of an interrupted surface. Compared to FIG. 7, it may be seen that in the exemplary embodiment shown in FIG. 10 axially extending incisions 93 have been formed in the region of the first guide element 25. The cams 92 lead, by interacting with internal first guide surfaces 45 in the region of the first portion 40 of the pipette tip 14, to radial or lateral orientation of the pipette tip 14 in relation to the coupling element 4.

The coupling elements described hereinbefore can be arranged on manual pipette mounts but also on pipetting machines having a large number of coupling elements. Pipetting machines of this type also have still further components, in particular means for stripping the pipette tips. Conventionally, these means comprise a stripper which can move relative to the coupling element in the axial direction, engages after the trailing end 12 of the pipette tip 10 and slides said pipette tip counter to the sliding-on direction 2 of the coupling element.

Figure 8:
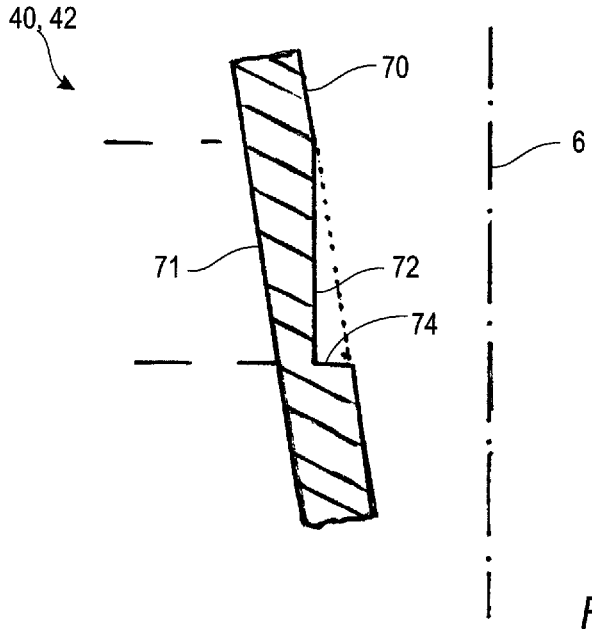
FIG. 8 shows a coupling portion of a first exemplary embodiment of a pipette tip.

FIG. 8 is an enlarged view of a portion (first portion 40 and/or second portion 42) of the pipette-side coupling portion. This portion has a conically tapering inner wall (inner surface) 70. The cone angle (angle between the inner wall 70 and longitudinal axis 6) is only a few degrees and lies preferably between 0.5° and 1°. This slightly conical embodiment is what is known as a mold release bevel in order to release the pipette tip, which is shaped as an injection-molded part, more easily from the injection mold. As may be seen, the outer wall (outer surface) 71 of the coupling portion also extends conically for this reason. A cylindrical guide surface 72 is integrated into the inner wall 70, i.e. the guide surface 72 extends in the longitudinal direction parallel to the longitudinal axis 6. This forms between the guide surface 72 and inner wall a heel 74, the depth of which depends on the cone angle and the longitudinal extension of the guide surface 72. It is beneficial if the guide surface merges directly with the conical inner wall 70 toward the wide end of the cone.

In order for the guide surface 72 to allow sufficiently precise axial orientation of the pipette tip, the wall of the pipette tip should be embodied so as to be sufficiently rigid in this region. As the cone angle is, as described hereinbefore, typically very small, the formation of the cylindrical guide surface 72 leads only to a negligible reduction in the thickness of the wall, thus ensuring sufficient stability even in the region of the guide surface 72. If appropriate, the wall as a whole should be embodied so as to be correspondingly thicker. Typically, a cylindrical guide surface is embodied merely on the inner wall 70. The outer wall 71 has on the other hand typically a conical course.

Figure 9:
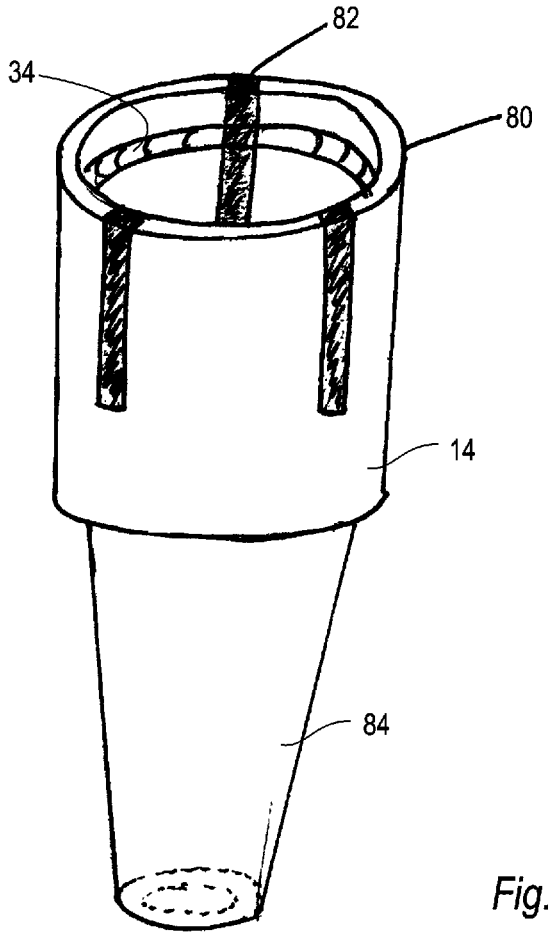
FIG. 9 shows a second exemplary embodiment of a pipette tip.

FIG. 9 shows an embodiment with improved flexibility of the pipette-side coupling portion 14. As may be seen, the coupling portion 14 (or the second portion of the pipette tip) has incisions 82 which extend in the longitudinal direction and are filled with a separate material in order to form axial soft components. The material 82 of the axial soft components 82 is more resilient than the material 80, of which the main part of the coupling portion 14 consists, and increases as a result the radial flexibility of the coupling portion. The incisions 82 can, as indicated in FIG. 9, penetrate the undercut 34 to receive the coupling element-side holding element. An injection-molding method can also be used to manufacture two-component pipette tips of this type. The pipette tip also has a portion 84 which is attached to the coupling portion 14, tapers conically in the axial direction and has at its axial end, remote from the coupling portion 14, an opening for drawing in a medium to be pipetted.

Generally, the total volume of the pipette tip is not particularly limited. For example, pipette tips can, as described above, be configured in such a way that they have a receiving volume in the receiving region, i.e. in the region of the pipette tip in which the medium to be pipetted is received (receiving portion), including the outlet portion for dispensing the medium, of from 5 to 2,000 μl, preferably from 40 to 1,800 μl, more preferably from 50 to 1,500 μl.

The length of a pipette tip is conventionally obtained from the desired volume if the geometry of the individual portions of the receiving region is defined. The length of the pipette tip is therefore generally not particularly limited. For example, the pipette tips can have a length in the range of from 50 to 150 mm, preferably from 60 to 140 mm and most preferably from 80 to 120 mm. In a particularly preferred embodiment, pipette tips having a receiving volume of 50 μl have a length of 60 mm, pipette tips having a receiving volume of 200 or 1,000 μl each have a length of 80 mm, and pipette tips having a receiving volume of 1,500 μl have a length of 120 mm.

In the case of all embodiments, the pipette tip can consist of polypropylene and be filled with graphite in order to allow capacitive level measurements.

The sealing element can in the case of all embodiments consist of fluoroelastomer, for example Viton® or Kalrez® from DuPont. Depending on the medium to be pipetted, other resilient materials are likewise suitable.

The coupling elements, which are often referred to also as the "mandrel", consist of a preferably corrosion-resistant metal, for example stainless steel or other alloys containing for example tantalum, titanium or tungsten. Nevertheless, it is also possible to make the coupling elements from suitable, for example conductive, plastics material. Also possible are composites made up of different materials, for example stainless steel with plastics material inlays or compounds of different, conductive and non-conductive plastics materials.

A common feature of the embodiments described hereinbefore is that they allow the pipette tip to be placed and stripped with the application of comparatively little force. This is achieved on the one hand as a result of the coupling element-side flexible holding elements and on the other hand as a result of flexible regions of the trailing end 12 of the pipette tip. In addition, all coupling elements have a low-wear or even wear-free seal, as the sealing element is embodied as an axial sealing element. The guide elements permit precise radial or lateral (x and y directions) positioning and prevent tilting of the pipette tip. The axial positioning (z direction) is defined on the one hand by the interplay of the coupling element-side holding element with the pipette tip-side holding means and on the other hand by the pressing of the shoulder 43 against the sealing element 21. The seal and the fastening are thus spatially and functionally separated from each other and allow positionally secure fastening of the pipette tip to the coupling element. Both the pipette tip and the coupling element can be manufactured cost-effectively and are robust in use.

List of Reference Numerals

| | |
|---|---|
| 2 | Sliding-on direction |
| 4 | Coupling element |
| 5 | Through-opening |
| 6 | Longitudinal axis |
| 8 | Free end of the coupling element |
| 10 | Pipette tip |
| 12 | Trailing end of the pipette tip/first axial end |
| 14 | Coupling portion of the pipette tip |
| 20 | First portion of the coupling element |
| 21, 21' | Sealing element |
| 22 | Second portion of the coupling element |
| 23, 23' | Sealing portion |
| 25 | First guide element |
| 26 | Second guide element |
| 27 | Annular spring/holding element |
| 28, 29 | Outer edge |
| 30 | Annular groove |
| 31 | Inner wall of the annular groove |
| 34 | Depression/undercut |
| 40 | First portion of the pipette tip |
| 42 | Second portion of the pipette tip |
| 43 | Sealing portion/shoulder |
| 45 | First guide surface |
| 46 | Second guide surface |
| 47 | Undercut |
| 50 | Stop surface |
| 57 | Cams/holding element |
| 60 | Annular groove |
| 61, 62 | Side walls of the annular groove 60 |
| 63 | Inner wall of the annular groove 60 |
| 65, 66, 67 | Run-on flanks |
| 68 | Insertion bevel |
| 69 | End surface |
| 70 | Inner wall |
| 71 | Outer wall |
| 72 | Guide surface |
| 74 | Shoulder |
| 80 | First material |
| 82 | Second material |
| 84 | Conical portion |
| 90 | Cams/holding element |
| 91 | Incision |
| 92 | Cams/first guide element |
| 93 | Incision |

We claim:

1. A pipette tip for placing on a mount, the pipette tip comprising:

a coupling portion extending in a longitudinal direction, the coupling portion having a first portion at a first end of the coupling portion and a second portion at a second end of the coupling portion opposite the first end, wherein at least one of the first portion and the second portion has an inner wall which tapers conically in the longitudinal direction and a guide surface which is cylindrical in relation to the longitudinal direction, and wherein the inner wall surrounds a first end of the guide surface and a second end of the guide surface opposite the first end.

2. The pipette tip of claim 1, wherein the inner wall has an angle between 0.5° and 3°0 with respect to the longitudinal direction.

3. The pipette tip of claim 1, wherein the first portion has a smaller radial extension than the second portion.

4. The pipette tip of claim 3, wherein the first portion comprises the guide surface and the inner wall.

5. The pipette tip of claim 3, wherein the first portion and the second portion each comprise a cylindrical guide surface and a conical inner wall.

6. The pipette tip of claim 3, further comprising a sealing portion between the first portion and the second portion having a sealing surface facing away from the first portion in the longitudinal direction.

7. The pipette tip of claim 3, wherein the second portion comprises the guide surface and the inner wall, and further comprising at least one holding means arranged in the inner wall.

8. The pipette tip of claim 7, wherein the holding means is an undercut.

9. The pipette tip of claim 1, wherein the pipette tip comprises an injection-molded polypropylene.

10. The pipette tip of claim 1, wherein at least a part of the second portion is more flexible in relation to the remainder of the coupling portion.

11. The pipette tip of claim 1, wherein the coupling portion consists of a first material and has incisions which extend in the longitudinal direction and are filled with a second material which is more resilient than the first material.

12. The pipette tip of claim 6, wherein the sealing portion is a shoulder between the first portion and the second portion.

13. The pipette tip of claim 6, further comprising at least one holding means arranged in an inner wall of the second portion, wherein a distance between the sealing portion and the holding means is greater than a radial extension of the holding means.

14. The pipette tip of claim 3, further comprising at least one holding means arranged in an inner wall of the second portion, wherein a distance between the guide surface and the holding means is greater than a radial extension of the holding means.

15. The pipette tip of claim 1, further comprising at least one holding means arranged in an inner wall of the second portion, wherein a sealing portion is arranged between the guide surface and the holding means.

* * * * *